United States Patent [19]

Lea, III

[11] 4,030,919

[45] June 21, 1977

[54] CONTINUOUS METHOD OF AND APPARATUS FOR MAKING BARS FROM POWDERED METAL

[75] Inventor: Paul M. Lea, III, Dolton, Ill.

[73] Assignee: Amsted Industries Incorporated, Chicago, Ill.

[22] Filed: Mar. 21, 1975

[21] Appl. No.: 560,577

[52] U.S. Cl. ..... 75/214; 75/200; 264/111; 425/79; 425/149; 425/258

[51] Int. Cl.[2] ..... B22F 3/16; B22F 3/20

[58] Field of Search ..... 75/200, 214; 425/78, 425/79, 149, 258; 264/111

[56] References Cited

UNITED STATES PATENTS 3,897,184 7/1975 Woodburn et al. ..... 75/200 X

*Primary Examiner*—Richard E. Schafer
*Attorney, Agent, or Firm*—Fred P. Kostka

[57] ABSTRACT

Powdered metal is continuously introduced into a horizontally disposed die cavity in discrete quantities and compacted into bar segments to form a bar. The cavity has a fixed cross-sectional area and is open at both ends, except during the initial compaction when one end is closed. After formation of an initial length of the bar, the frictional resistance between the length of bar remaining in the cavity and the cavity wall is relied on so that the length of bar remaining in the cavity serves as a stopper for subsequent compactions of the discrete quantities of powdered metal. The bar is forced out of the cavity upon the formation of subsequent segments and is passed through an induction furnace for sintering, and may be further processed through a swager, all preferably in a continuous operation. Also provided is means for varying the quantity of powdered metal introduced into the die cavity so that the bar lengths formed from the discrete quantites of powdered metal are compacted and bonded into a bar of substantially uniform physical characteristics along its length.

5 Claims, 5 Drawing Figures

FIG. 3
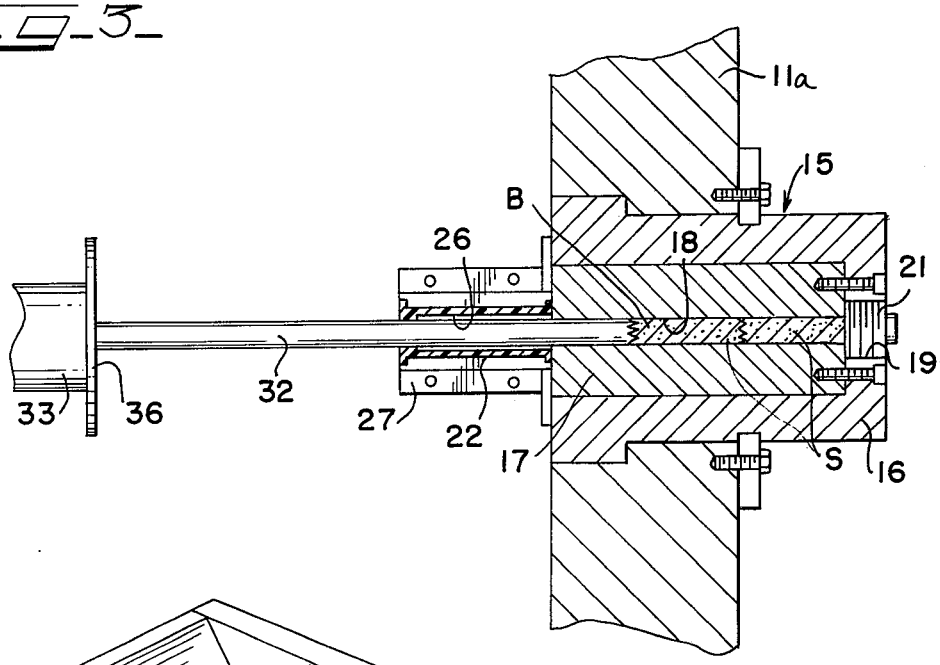
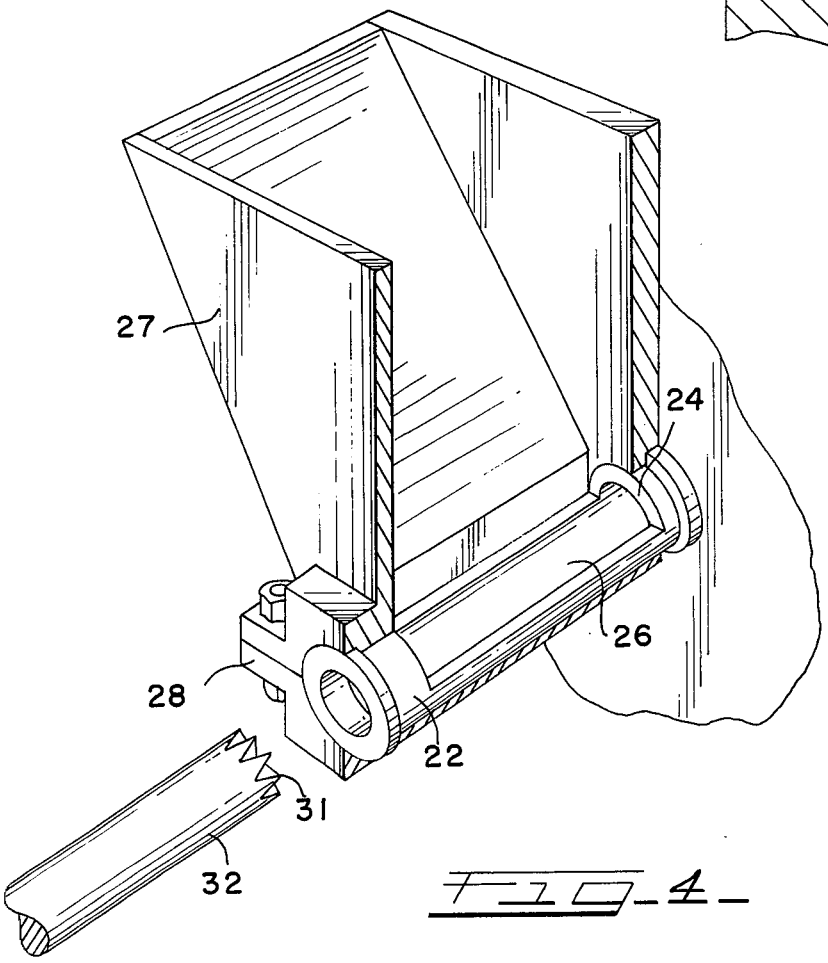
FIG. 4

CONTINUOUS METHOD OF AND APPARATUS FOR MAKING BARS FROM POWDERED METAL

BACKGROUND AND SUMMARY OF THE INVENTION

The present invention relates to a method and apparatus for making a rod from powdered metal, and more particularly to a new and novel method for continuously forming the rod from powdered metal and to a new and novel apparatus for carrying out the method.

The present method and apparatus are an improvement of the method and apparatus described in U.S. Pat. application, Ser. No. 448,819 filed Apr. 7, 1974 assigned to the assignee of the present invention and which is incorporated herein by reference thereto.

By the present invention it is proposed to provide an improved method for continuously forming a bar from a powdered metal wherein successive separate quantities of powdered metal are compacted by compacting means axially movable in a generally horizontally disposed die having a cavity of fixed cross-sectional area. The successive quantities of powdered metal are compacted into bar segments and bonded to each other to form a length of green compact bar. The green compact bar is incrementally forced out of the die such that a length thereof is frictionally retained within the die to serve as a stopper against which a succeeding quantity of powdered metal is compacted. The frictional resistance force between the cavity wall and the length of the bar defining the stopper is measured. This measurement is used to determine if the frictional resistance force corresponds to the compacting force required to compact the quantity of powdered metal into a bar segment having desired physical characteristics. If the frictional force deviates from the required force, the length of travel of the compacting means is changed so that the volume of powdered metal introduced into the die cavity is varied until it is compressed into a green bar segment having the desired green strength physical characteristics.

In accordance with the present invention, the apparatus includes a feed tube that communicates with a source of powdered metal and is axially aligned with the die cavity in which the powdered metal is compressed. A punch is axially reciprocable within both the die cavity and the feed tube and serves to compact the powdered metal. The punch travels between a retracted position within the feed tube and a compacting position within the die cavity. The compacting position of the punch within the die cavity is maintained constant while the retracted position in the feed tube is varied so that the volume of powdered metal introduced therein is varied. In this manner, the volume of powdered metal compacted in the die cavity is varied until a bar segment is formed having the desired green strength characteristics. The volume of powdered metal is thereafter maintained substantially the same so that each segment forms a bar of uniform green strength characteristics along its length.

The green compacted rod formed in the continuous manner as described above is then sintered to improve the physical characteristics after emerging from the die. Preferably the sintering is performed by induction heating means.

After sintering the rod may also be swaged or otherwise hot worked to further increase the density thereof.

Further features of the invention will hereinafter appear.

BRIEF DESCRIPTION OF THE DRAWINGS

FIG. 3 is a top plan view partially in cross-section taken generally along the lines 3—3 of FIG. 1 and showing the feed tube and powdered metal compacting means.

FIG. 4 is a fragmentary prespective view of the feed trough and compacting die and for showing purpose of illustration only the compacting punch completely retracted from the feed tube.

DESCRIPTION OF THE PREFERRED EMBODIMENT

Figure 1:
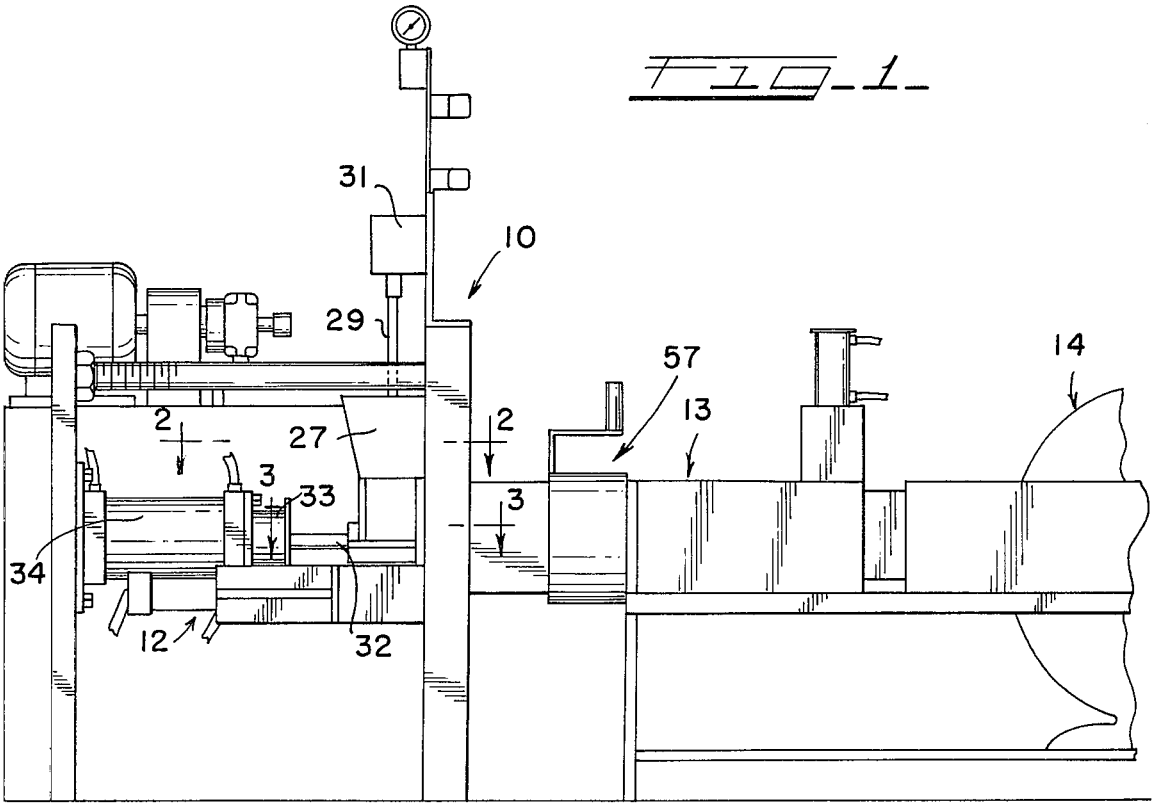
FIG. 1 is a side elevational view of an apparatus for carrying out the method of the invention.

Referring now to the drawings there is shown a compacting press 10 including a frame 11 on which there is supported a powdered metal compacting subassembly 12, and a sintering unit 13. A swaging unit 14 may also be incorporated in the press and may be located to the right of the sintering unit 13 as viewed in FIG. 1.

The powdered metal compacting subassembly 12 includes a die 15 which is suitably secured in a wall 11*a* of the frame 11 as shown in FIG. 3. The die 15 includes an exterior housing 16 which is suitably fastened in an opening in the wall 11*a*. A die body 17 made from a hardened steel is firmly fixed in the exterior housing 16 as by screws. The die body 17 includes an axially extending open ended bore or cavity 18 which communicates with a threaded opening 19 in the exterior housing 16. A plug 21 is threaded in the opening 19 and is removed after the initial bar length or segment is formed as will be more completely explained hereinafter.

Disposed in axial alignment with the die bore 18 is a powdered metal feed tube or sleeve 22 which may be made from plastic such as teflon or the like. The feed tube 22 is of generally cylindrical configuration and includes a longitudinally extending slot 24 through which the powdered metal enters a feed bore 26. A hopper trough 27 in which the powdered metal is stored has an outlet end disposed in alignment with the slot 24. A clamping bracket 28 serves to hold the trough 27 and feed sleeve 22 secured. A stirrer 29 operated by a motor 31 is located in the trough 27 to agitate the metal powders.

Disposed within the feed sleeve 22 and axially movable between a retracted position spaced lengthwise from the die cavity 18 and a compressed or compacted position within the die bore 18 is a punch 32 having a serrated or waffle-like end 31. In this connection it should be mentioned that while the end 31 of the punch 32 is illustrated in FIG. 4 as being spaced from the feed sleeve 22, normally the end 31 is disposed within the length of the sleeve. The punch 32 is connected to the outer end of a ram 33 of a hydraulic ram 34 by means of punch holder. The hydraulic ram 34 is of the type permitting adjustment of the stroke of the ram 33 and thereby the punch 32. A position sensing plate 36 is fixed to one end of the ram 33 and serves to control the length of travel of the punch 32 for controlling the volume of powdered metal compacted at each stroke. The control of the volume of powdered metal serves to maintain the green strength characteristics of the bar to be formed substantially the same along its entire length.

Figure 2:
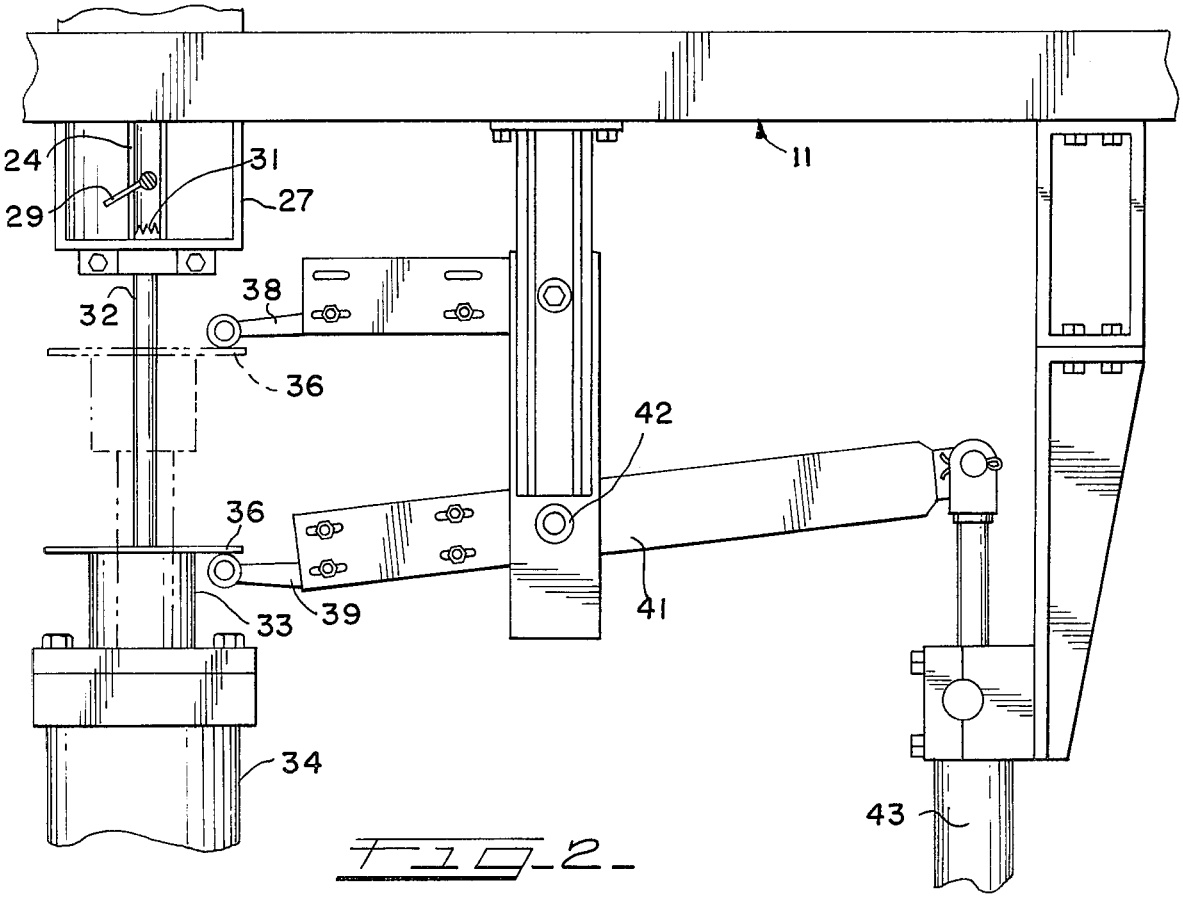
FIG. 2 is a fragmentary top plan view of the powdered metal feed trough and its relationship to the compacting means taken generally along the lines 2—2 of FIG. 1.

The position sensing plate 36 in the extended position of the piston rod as shown in phantom lines in FIG. 2 is engageably with a limit switch 38 and in its retracted position a limit switch 39. The limit switch 38 is fixedly mounted on the frame 11 and senses the position of the punch 32 at the completion of the compaction stroke.

The limit switch 39 is mounted on one end of an arm 41 which is pivotal about a pivot 42. The other end of the arm 41 is turnably connected to a stroke adjusting cylinder 43. The stroke adjusting cylinder 43 is associated with the ram 34 so as to be capable of adjusting its stroke and thereby the stroke of the punch 32. In this arrangement the volume of powdered metal compressed in the die 15 is determined by varying the length of the retraction stroke. This variation in volume is used to maintain a substantially constant or uniform green strength characteristic along the length of the bar as it is being formed.

Initially powdered metal of about − 42 mesh of a desired composition such as that described in the aforementioned application is introduced into the hopper trough 27. A suitable wax is included in the powdered metal composition and serves to provide a lubricant which facilitates passage of the compacted powdered metal through the die. The powdered metal composition, which is agitated by the agitator 29, flows by way of gravity through the slot 24 of the guide sleeve 22 into the feed bore 26. The volume of powdered metal deposited in the guide sleeve 22 is controlled by the space between the end 31 of the punch 32 in the retracted position and the opposite end of the slot 24. In this manner the volume of powdered metal introduced into the die 15 is controlled.

The punch 32 moves to its fully compressed position to compress and compact the powdered metal against the plug 21. The compressed powdered metal forms a segment and is in frictional engagement with the side wall of the cavity 18. The frictional forces between the cavity wall 18 and the compressed powder metal segments is such that the segment serves as a plug or stop means so that the plug 21 may be removed. Under some circumstances a plurality of quantities of powder metal may be compacted prior to removal of the plug 21 to achieve a length of bar having the requisite frictional forces with the cavity wall so that the segment serves as a stopper.

After removal of the stopper 21 successive quantities of powdered metal are introduced into the cavity 18. After each successive quantity of powdered metal, compaction takes place against the previously formed segment and the segment is bonded thereto to form a bar. During the compaction stroke the force exerted by the punch continuously increases until the force transmitted through the compacted segment is sufficient to overcome the frictional forces between the green bar B and the cavity wall 18 so that the bar at least partially projects out of the cavity 18. This process is repeated until the bar is of a desired length.

Figure 5:
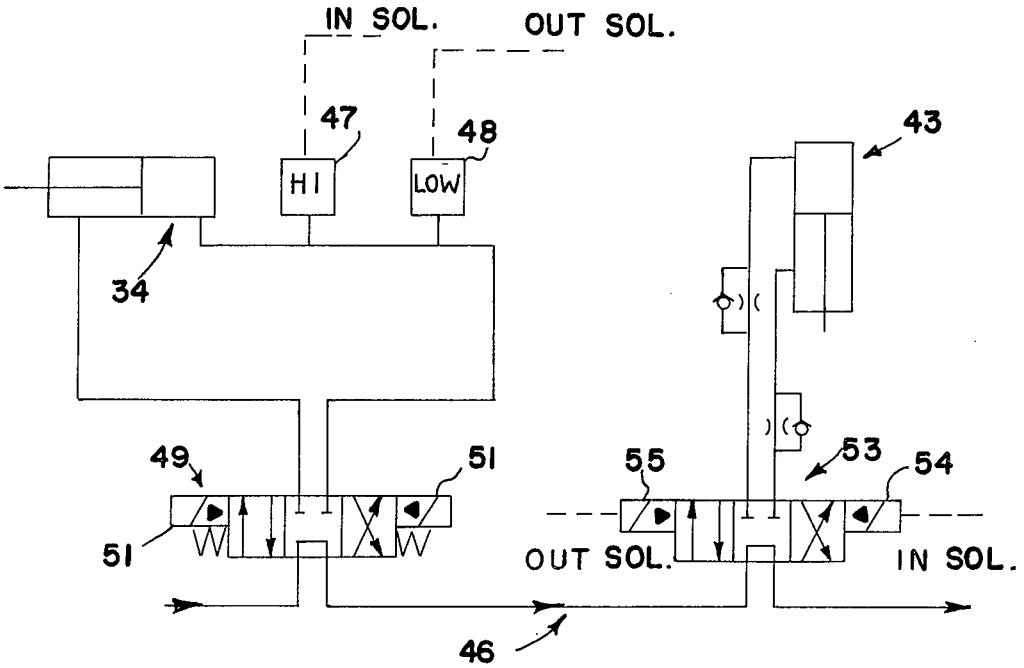
FIG. 5 is a schematic view of the electro-hydraulic actuating system for varying the length of travel of the compacting punch.

Referring now to FIG. 5 there is shown the schematic diagram of the control system for controlling the length of the stroke of the press ram 34 thereby to change the volume of the powdered metal introduced in the die cavity 18. As mentioned heretofore, the stroke of the press ram 34 is adjusted by the stroke adjusting cylinder 43. To this end the ram 34 is incorporated in a hydraulic circuit 46 which also includes "high" and "low" pressure switches 47, 48 respectively. These switches are ordinary pressure actuated switches and are responsive to the pressure forces sensed in the ram 34. FIG. 5 also shows a hydraulic valve 49 actuated by solenoids 51—51 which in turn are activated by internal controls (not shown) in the press for reciprocating the stroke adjusting cylinder 43 as referred to above. This valve and the actuation thereof by the solenoids are well-known in the art.

The stroke adjustment ram 43 is associated with the hydraulic valve 49 and solenoid 51 for controlling the length of the stroke of the ram 34. Controlling the stroke adjustment ram 43 is a hydraulic valve 53 also of known kind and which may be of the same type as the valve 49. The hydraulic valve is actuated by an "in" solenoid 54 and an "out" solenoid 55 controlled, respectively, by the high and low pressure switches 47, 48. As the press ram 34 extends to engage limit switch 38, the switches 47, 48 sense the pressure applied by the ram 34. If the pressure sensed is higher than a predetermined maximum valve the high pressure switch 47 energizes the "in" solenoid 54 which thereby actuates the valve 53 which controls the stroke adjusting cylinder 43, retracting the piston therein and rotating the arm 42 to move the limit switch 39. This shortens the extent to which the press ram 34 moves outwardly of the die 15, as viewed in FIG. 2. Thus a lesser volume of powdered metal is supplied in the die in the succeeding compaction cycle so that the succeeding sensed pressure is lower. If this lower sensed pressure is between the predetermined maximum and a predetermined minimum the limit switch 39 remains stationary. On the other hand, if the pressure is less than a predetermined minimum value the low pressure switch 48 senses that pressure, and actuates the "out" solenoid 55 which actuates the cylinder 43 in the opposite direction to an extended position. This results in moving the limit switch 39 outwardly to lengthen the travel of ram 34 and results in a greater volume being compacted on the subsequent compaction. When the pressure sensed falls between the maximum and the minimum the powdered metal volumes are compressed in segments having substantially uniform green strength characteristics.

It is apparent that the force exerted by the punch 32 in compacting the powdered metal in the die 15 against the previously formed length of bar remaining seated in the die is measured. This compacting force also equals the resisting frictional force between the previously formed length of bar plus that of the newly formed slug and the die wall. As heretofore mentioned, the frictional force between the bar and the cavity wall 18 serve to retain the bar within the die 15 to provide a stop means against which the powdered metal is compacted. The compacting and the corresponding ejecting force must therefore be greater than the frictional force existing at the cavity wall. At the same time the force must not be of a magnitude that causes compacted powder to be wedged within the cavity so that it cannot be extracted without either damaging the bar or the die. On the other hand, the force applied must be such that the powdered metal is compacted and bonded to the previously formed length of bar. In establishing the pre-requisite force, the initial pressing force or pressure is critical in order to produce a bar having the desired green compact characteristics, primarily density. Preferably, such green compact bar should have about a 70% density so as to be self-supporting and capable of withstanding the handling forces imposed thereon during transfer to a sintering or swaging station or the like.

Prior to sintering the green compact bar passes through a heater 57, as shown in FIG. 1. The heater 57 serves to remove the wax lubricant from the compacted bar.

Thereafter the green compact bar continues to travel outwardly of the die through the induction heating unit 13 wherein it is sintered. Further movement causes the sintered bar to enter the swaging unit 14.

What is claimed is:

1. A continuous method of forming a bar from a powdered metal comprising, successively introducing outwardly of one end a quantity of powdered metal into an open ended and horizontally disposed die cavity of fixed diameter, applying a horizontally disposed reciprocating compacting means movable between a retraction position outside of said die and a compaction position within said die to compact each quantity of powdered metal into bonded segments of a bar of which at least a length of the bar frictionally engages the walls of the die cavity and serves as a stop means against which subsequent quantities of powdered metal are compacted and bonded to form further segments of the bar, measuring the frictional resisting force of the length of the bar in the cavity relative to a predetermined resisting force at which a subsequent quantity of powdered metal is compacted into a segment of predetermined physical characteristics, controlling the travel of the compacting means by varying the retraction position of said compacting means while maintaining the compaction position thereof constant so that the quantity of powdered metal introduced in the die cavity to achieve a compaction compensates for deviations of the measured force from the predetermined resisting force and the successive quantity of powdered metal is bonded to the bar as a segment having the desired physical characteristics, and forcing the bar through the die so that at least a length of said bar serves as the stop means.

2. The method as defined in claim 1 wherein said compacting means is substantially horizontally axially applied in the die to compact each of said quantities of powdered metal.

3. The method as defined in claim 2 wherein the frictional resisting force of the length of bar in the cavity is measured at the compaction position of said compacting means.

4. The method as defined in claim 2 wherein the bar is continuously sintered as the bar emerges from the die.

5. The method as defined in claim 4 wherein the bar is continuously swaged as the bar emerges from the die.

* * * * *